United States Patent [19]

Garau

[11] Patent Number: 5,044,655

[45] Date of Patent: Sep. 3, 1991

[54] SKI BINDING FOR A CROSS-COUNTRY OR TOURING SKI

[75] Inventor: Jean P. Garau, Villeneuve Loubet, France

[73] Assignee: TMC Corporation, Baar, Switzerland

[21] Appl. No.: 469,593

[22] PCT Filed: Jul. 13, 1989

[86] PCT No.: PCT/EP89/00815

§ 371 Date: Mar. 28, 1990

§ 102(e) Date: Mar. 28, 1990

[87] PCT Pub. No.: WO90/00918

PCT Pub. Date: Feb. 8, 1990

[30] Foreign Application Priority Data

Jul. 28, 1988 [AT] Austria ..... A1917/88

[51] Int. Cl.[5] ..... A63C 9/00

[52] U.S. Cl. ..... 280/615

[58] Field of Search ..... 280/614, 615, 624, 625, 280/631

[56] References Cited

U.S. PATENT DOCUMENTS

| | | | |
|---|---|---|---|
| 3,632,123 | 1/1972 | Salomon | 280/628 |
| 4,093,269 | 6/1978 | Hoffman | 280/615 |
| 4,533,154 | 8/1985 | Bernard et al. | 280/615 |

FOREIGN PATENT DOCUMENTS

| | | | |
|---|---|---|---|
| 347311 | 12/1978 | Austria . | |
| 386127 | 7/1988 | Austria . | |
| 0176951 | 4/1986 | European Pat. Off. | 280/615 |

*Primary Examiner*—Andres Kashnikow
*Assistant Examiner*—Richard Camby
*Attorney, Agent, or Firm*—Flynn, Thiel, Boutell & Tanis

[57] ABSTRACT

A ski binding for a cross-country or touring ski is shown, with a boot (100) being introduced into a holding cup (40) and being held therein by a locking pin (32), when a pawl (60) prevents the reciprocal movement of holding cup (40) and locking pin (32). The design of a double groove (43*a*, 43*b*) enables a locking even when an obstacle (13) prevents the complete lowering of the bottom (41) of the holding cup (40).

1 Claim, 5 Drawing Sheets

SKI BINDING FOR A CROSS-COUNTRY OR TOURING SKI

FIELD OF THE INVENTION

The invention relates to a ski binding for a cross-country or touring ski comprising a bearing block for its fastening on the ski and comprising a holding cup to receive the front end area of a ski boot, which carries at its front end area a bar approximately U-shaped in the top view, the crossbar of which U-shaped bar is spaced from the tip of the ski boot and forms an opening with the tip, such that when the ski boot is inserted into the binding, its sole edge rests on top and bottom on the holding cup, which in the open position of the binding is spring-biased in the direction of a pivoting upwardly about a horizontal transverse axle lying in front of the boot and supported in walls of the bearing block and can be moved downwardly into a closing position by a pivoting caused by means of the ski boot, in which closing position at least one locking pin of the binding penetrates from below through the opening on the ski boot and a pawl pivotal about a further horizontal transverse axle is locked by means of a projection cooperating with a groove and in this manner fixes the holding cup and the locking pin relative to one another.

BACKGROUND OF THE INVENTION

Such a device has become known for example from Austrian Patent No. 386 127, which has proven to be successful in practice. The single little disadvantage observed up to now is that at times ice and hard snow exist in the very last portion of the closing path of the holding cup, so that only after removal of the obstacle or by applying considerable force will it be possible to move the U-shaped bar on the ski boot completely over the locking pin supported on the ski.

The purpose of the invention is thus to avoid the disclosed disadvantage and to guarantee the capability for the binding to function regardless of whether the holding cup can actually be pressed down entirely when a skier closes the binding with his or her ski boot.

To attain this purpose, the invention provides that through at least one further groove and/or a further projection lockable to the pawl, at least one further closing position of the binding is defined, in which the base of the holding cup, viewed in elevational direction, is spaced farther from the base plate of the bearing plate than in the first locking position of the pawl.

Also the European Patent Application 176 951 discloses a device having two locking positions for the pawl, however, it does not disclose a solution to the task which is the basis of the invention. The two locking positions of the known device correspond, namely, on the one hand, with the position during use and, on the other hand, with the open position of the binding. Whereas two closing positions, of which the first is reached even if ice prevents the total approach of locking pin and holding cup, has up to now not been suggested.

The structural design of the thought of the invention can obviously be accomplished with the same effect in such a manner that two grooves on the holding cup are associated with a projection on the pawl, which grooves cooperate alternatively with the projection, or that, in the reverse, alternately two projections on the pawl are locked in a groove on the holding cup.

The construction of the binding of the invention has the result that the cross-country skier can immediately go onto the skiing path even if the binding first only reaches a locking position whereat the locking pin is not yet quite fully moved in. After a few steps, the at first hindering ice is removed and the pawl arranged on the same pivot part as the locking pin locks in the position whereat the locking pin has penetrated as far as possible into the opening at the front of the boot.

BRIEF DESCRIPTION OF THE DRAWINGS

Further details of the invention will now be described in greater detail in connection with the drawings.

DETAILED DESCRIPTION

Figure 1:
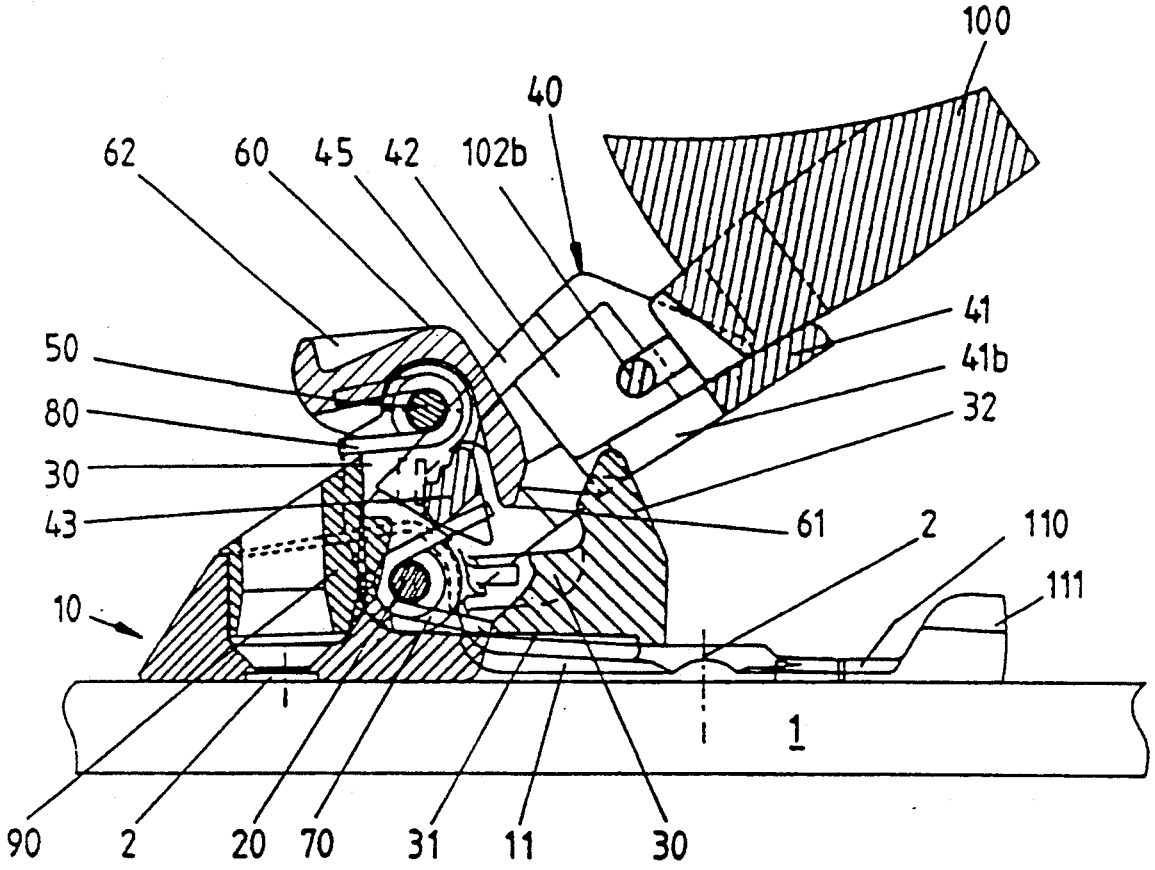
FIG. 1 is a longitudinal cross-sectional view taken along the line I—I of FIG. 2 of the ski binding of the invention in the stepping-in position.
Figure 2:
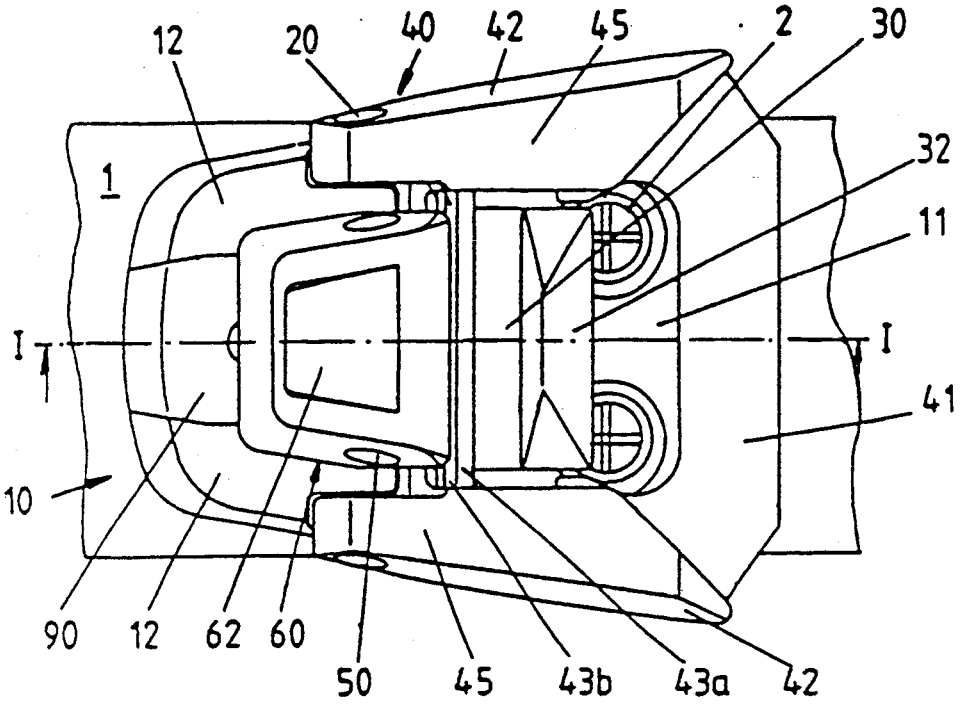
FIG. 2 is a top view of the ski binding in the skiing position.

The drawings show a ski binding for a cross-country or touring ski 1 and a ski boot 100 therefor. A bearing block 10 is mounted on the upper side of the ski 1 by means of screws mounted at reference numeral 2. The bearing block 10 includes a base plate 11 having two walls 12 starting at the front end of the base plate 11, which front end faces the tip of the ski, and extending approximately to the center of the base plate 11 and carrying a horizontal transverse axle 20 in the latter area.

A pivot part 30 is mounted on the transverse axle 20, which pivot part rests with its base 31 on the base plate 11. The base 31 has at its end remote from the transverse axle 20 a locking pin 32. A holding cup 40 is also mounted on the pivot axle 20, the base 41 of which holding cup has an opening **41*b* for the locking pin 32. The sidewalls 42 of the holding cup 40 are connected at its front part to a crossbar 43 carrying grooves 43*a* and 43*b*. Guide bars 45 are connected to the top of the sidewalls 42**.

An extension of the pivot part 30, which extension projects upwardly from the transverse axle 20, carries a transverse axle 50 at its upper end, to which axle a pawl 60, designed as a two-arm lever, is hinged. The arm of the pawl 60 facing the holding cup 40 terminates in a projection 61 forming a locking nose and on the side of its second arm, which side does not face the ski 1, a recess 62 is provided.

For a spring 70 around the transverse axle 20, which spring biases the holding cup 40 and the pivot part 30 in a spread apart relation, suitable cavities exist in the base 31 of the pivot part 30. A torsion spring 80 extending about the transverse axle 50 biases the pawl 60 in a closing direction toward the holding cup 40.

An elastic element 90 is inserted in the front part of the bearing block 10. It is supported on the pivot part 30. The elastic element 90 has a bore in order to be able to insert unhindered a screw during installation of the binding on the ski 1.

Figure 3:
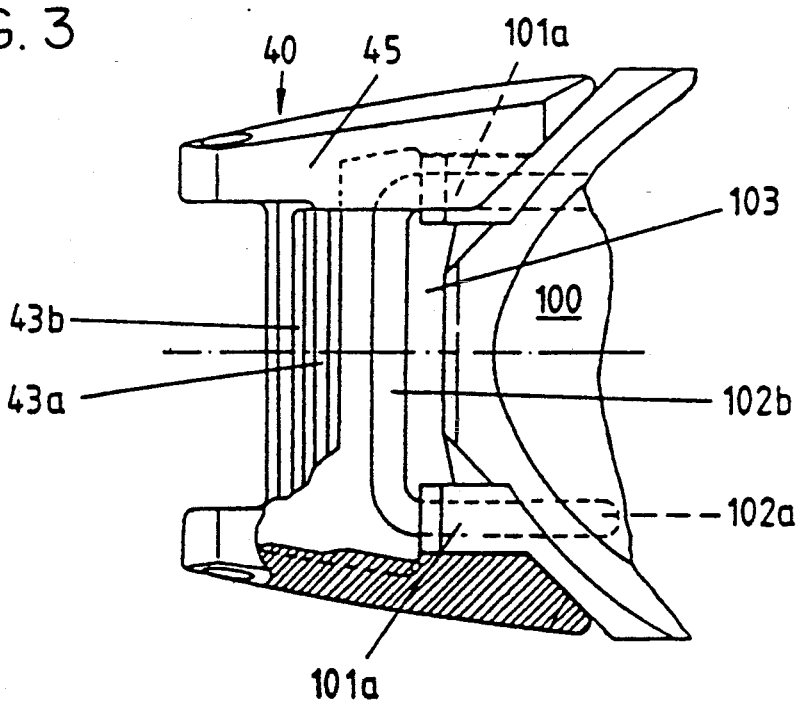
FIG. 3 is a top view of the holding cup of the ski binding with inserted ski boot.

The ski boot 100 (compare FIG. 3) to be inserted into the binding has a sole extension in its front area, which sole extension forms a slide-in part into the holding cup 40 and consists of a U-shaped bar with extensions 101*a* and a crossbar 102*b*, which U-shaped bar is cast with its legs 102*a* into the extensions.

Figure 4:
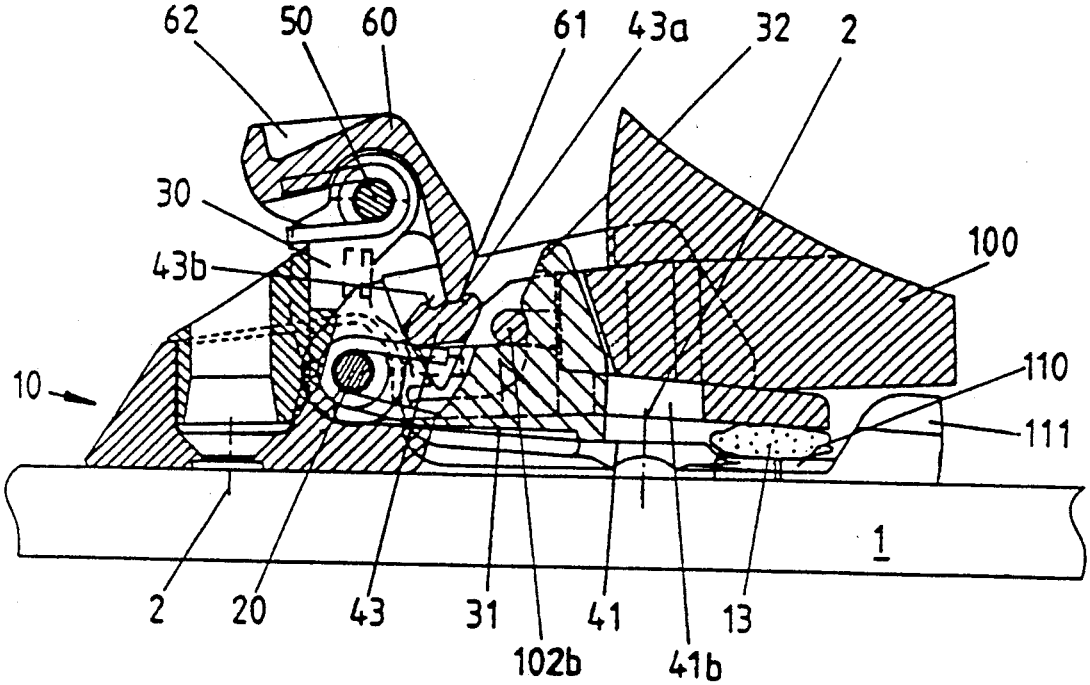
FIG. 4 is a longitudinal cross-sectional view of the ski binding in the skiing position (first locking position)
Figure 5:
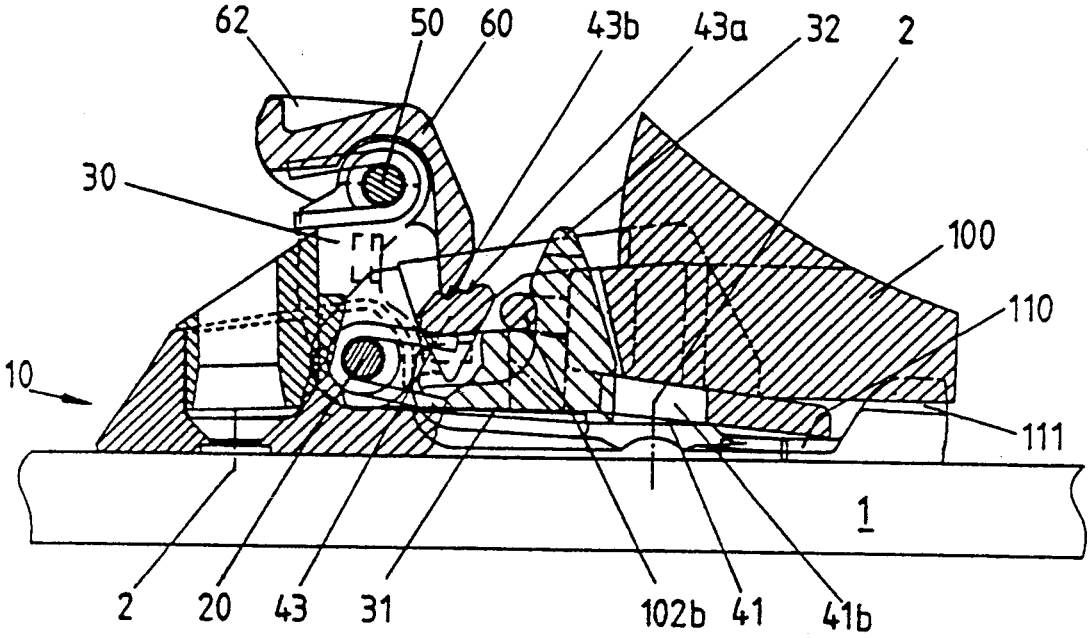
FIG. 5 is a longitudinal cross-sectional view of the ski binding in the skiing position (second locking position)

The basic idea of the invention can best be understood from FIGS. 4 and 5. If a piece of ice or hard snow 13 gets under the base 31 of the angular pivot part 30 ending in the locking pin 32 and carrying the pawl 60, then the pawl 60 with its projection 61 first engages only the first groove 43*a*, viewed in closing direction, of the bar 43. The base 31 of the pivot part 30 projects in this position slightly downwardly over the base 41 of the holding cup 40. Also the locking pin 32 is not yet in its end position above the opening 103 defined by the sloped front side of the ski boot 100 and the crossbar 102*b*. However, this hardly influences the skier since the binding is closed and thus the ski boot 100 can be fixed in the holding cup 40 of the binding. The base 41 of the holding cup 40 rests during each sliding step on the obstacle 13 consisting of ice or hard snow until same is—generally after a few steps—removed from or rather pressed out of the binding. The pawl 60 engages now with its projection 61 the second groove 43*b* of the bar 43, viewed in the closing direction, thus reaching the end position shown in FIG. 5. The locking pin 32 has in this end position completely penetrated into the opening 103 on the ski boot 100 and the base 31 of the pivot part 30 and the base 41 of the holding cup 40 extend in the swung-down position of the ski boot 100 (sliding phase) substantially flush to one another.

A guide plate 110 with guide grooves 111 for the ski boot 100 is provided behind the ski binding and following the ski binding. Design and function of such guide plates are known by themselves, so that these do not need to be discussed any further.

Figure 6:
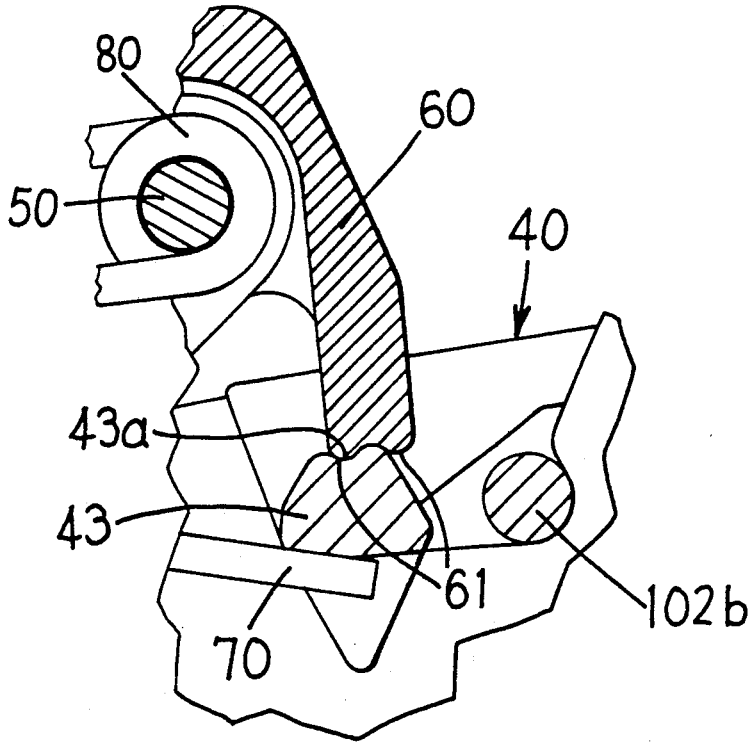
FIG. 6 is an enlarged fragment of a view corresponding to FIG. 4, but showing a modified pawl and bar construction.

The invention is not to be limited to the illustrated and described exemplary embodiment. If needed, it is possible, as mentioned in the beginning and as it is also claimed, to provide several grooves determining different locking positions. Furthermore, it is also possible, as has also been described and claimed, to provide several projections 61 engageable in a groove. Also the cooperation of several projections with several grooves 43*a*, as shown in FIG. 6 is supposed to fall under the protection of the patent.

The embodiments of the invention in which an exclusive property or privilege is claimed are defined as follows:

1. In a ski binding for a cross-country or touring ski, comprising a bearing block on a base plate which is adapted to be fastened onto the ski and comprising a holding cup adapted to receive a front end region of a ski boot, which ski boot has at its front end area a generally U-shaped bar, a crossbar portion of the U-shaped bar being spaced from a tip of the toe portion the ski boot and forms an opening with said tip such that, when the ski boot is inserted into the binding, top and bottom sole edges of the ski boot engage top facing and bottom facing surfaces provided on the holding cup, a spring means for biassing the holding cup toward an open position of the binding in an upward direction about a horizontal transversely extending axle located in front of the ski boot, the holding cup being pivotally supported between upstanding walls of the bearing block and is adapted to be manually pivotally moved downwardly into a closed position by means of the ski boot, in which closed position at least one locking pin of the binding penetrates from below through the opening defined by the bar on the toe of the ski boot, and a pawl pivotally supported for movement about a further horizontal transversely extending axle and has a projection thereon cooperatively received in a groove provided on the holding cup to thereby lock the holding cup and the locking pin relative to one another and in the closed position of the binding, the improvement wherein at least one of a further groove is provided on the holding cup and a further projection is provided on the pawl for defining at least one further closed position of the ski binding, said further closed position occurring when a bottom of the holding cup is spaced a larger distance from the base plate than in the first-mentioned closed position of the ski binding.

* * * * *